US010309335B2

(12) United States Patent
Klesse et al.

(10) Patent No.: US 10,309,335 B2
(45) Date of Patent: Jun. 4, 2019

(54) FUEL-SUPPLY SYSTEM FOR AN INTERNAL COMBUSTION ENGINE

(71) Applicant: Continental Automotive GmbH, Hannover (DE)

(72) Inventors: Christoph Klesse, Woerth A.D. Donau (DE); Thomas Riedel, Pettendorf (DE); Hans Riepl, Hemau (DE); Tobias Ritsch, Regensburg (DE); Michael Wirkowski, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/119,211

(22) PCT Filed: Aug. 17, 2015

(86) PCT No.: PCT/EP2015/068833
§ 371 (c)(1),
(2) Date: Aug. 16, 2016

(87) PCT Pub. No.: WO2016/058733
PCT Pub. Date: Apr. 21, 2016

(65) Prior Publication Data

US 2017/0211504 A1 Jul. 27, 2017

(30) Foreign Application Priority Data

Oct. 14, 2014 (DE) ..... 10 2014 220 742

(51) Int. Cl.
*F02B 7/00* (2006.01)
*F02D 41/38* (2006.01)
(Continued)

(52) U.S. Cl.
CPC ..... *F02D 41/3845* (2013.01); *F02D 41/042* (2013.01); *F02D 41/3863* (2013.01); *F02D 2250/02* (2013.01); *F02M 63/0225* (2013.01)

(58) Field of Classification Search
CPC ..... F02D 2041/223; F02D 2041/224; F02D 2200/0602; F02D 41/042; F02D 41/222;
(Continued)

(56) References Cited

U.S. PATENT DOCUMENTS 6,769,414 B2 * 8/2004 Rembold ..... F02D 33/006 123/179.17
6,772,738 B2 * 8/2004 Rembold ..... F02D 41/3854 123/456
(Continued)

FOREIGN PATENT DOCUMENTS

CN 1920282 A 2/2007 ..... F02D 41/22
DE 10118936 A1 11/2002 ..... F02M 55/02
(Continued)

OTHER PUBLICATIONS

German Office Action, Application No. 102014220742.8, 6 pages, dated Jul. 17, 2015.
(Continued)

*Primary Examiner* — Hai H Huynh
*Assistant Examiner* — Gonzalo Laguarda
(74) *Attorney, Agent, or Firm* — Slayden Grubert Beard PLLC

(57) ABSTRACT

The present invention relates to a method for operating a fuel supply system for an internal combustion engine, and to a corresponding device. The fuel supply system of an internal combustion engine may include: an outlet of a high-pressure pump coupled to a pressure-limiting valve and a high-pressure fluid accumulator. The method may include, when the internal combustion engine is set into a deactivated state,
(Continued)

actuating the high-pressure pump such that, at the outlet side of the high-pressure pump, a pressure is increased such that the pressure-limiting valve is opened.

12 Claims, 3 Drawing Sheets

(51) Int. Cl.
*F02D 41/04* (2006.01)
*F02M 63/02* (2006.01)

(58) Field of Classification Search
CPC ..... F02D 41/3845; F02D 2250/02; F02D 41/3863; F02D 41/3082; F02D 2250/31; F02M 63/0225; F02M 63/023; F02M 69/462; F02M 2037/087
USPC ..... 123/446, 457, 458, 495, 497, 510, 511; 73/114.41; 701/112
See application file for complete search history.

(56) References Cited

U.S. PATENT DOCUMENTS

| | | | | |
|---|---|---|---|---|
| 6,889,666 | B2 | 5/2005 | Oono | 123/514 |
| 7,263,972 | B2 * | 9/2007 | Tokuda | F02D 33/006 123/431 |
| 7,401,593 | B2 | 7/2008 | Rembold et al. | 123/467 |
| 7,552,716 | B2 | 6/2009 | Osaki | 123/457 |
| 8,855,889 | B2 | 10/2014 | Dölker | 701/102 |
| 9,133,783 | B2 * | 9/2015 | Slaymaker | F02D 41/065 |
| 9,327,706 | B2 * | 5/2016 | Reed | B60W 10/02 |
| 9,494,099 | B2 * | 11/2016 | Rieger | F02D 41/1454 |

FOREIGN PATENT DOCUMENTS

| | | | | |
|---|---|---|---|---|
| DE | 102004013307 | A1 | 9/2005 | F02M 1/00 |
| DE | 102009031529 | B3 | 11/2010 | F02D 41/38 |
| DE | 102010063586 | A1 | 6/2011 | F02D 17/00 |
| DE | 102012214635 | A1 | 2/2014 | F02M 37/00 |
| EP | 0886056 | A1 | 12/1998 | F02D 41/22 |
| EP | 2497939 | A1 | 9/2012 | F02M 55/04 |
| JP | 06249101 | A | 9/1994 | F02M 55/02 |
| JP | 2005098138 | A | 4/2005 | F02D 33/00 |
| JP | 2009079514 | A | 4/2009 | F02D 29/02 |
| JP | 2010031816 | A | 2/2010 | F02D 41/02 |
| JP | 2012145023 | A | 8/2012 | F02D 29/02 |
| WO | 2016/058733 | A1 | 4/1916 | F02D 41/04 |

OTHER PUBLICATIONS

International Search Report and Written Opinion, Application No. PCT/EP2015/068833, 11 pages, dated Dec. 2, 2015.
Japanese Office Action, Application No. 2016553881, 5 pages, dated Jun. 11, 2018.
Korean Office Action, Application No. 2018013285116, 7 pages, dated Feb. 23, 2018.
Chinese Office Action, Application No. 201580006673.0, 12 pages, dated Dec. 5, 2018.

* cited by examiner

FUEL-SUPPLY SYSTEM FOR AN INTERNAL COMBUSTION ENGINE

CROSS-REFERENCE TO RELATED APPLICATIONS

This application is a U.S. National Stage Application of International Application No. PCT/EP2015/068833 filed Aug. 17, 2015, which designates the United States of America, and claims priority to DE Application No. 10 2014 220 742.8 filed Oct. 14, 2014, the contents of which are hereby incorporated by reference in their entirety.

TECHNICAL FIELD

The present disclosure relates to internal combustion engines in general, and more specifically to methods for operating a fuel supply system and to corresponding devices.

BACKGROUND

Internal combustion engines are commonly designed to generate high torque, which requires large injection quantities. At the same time, legal regulations regarding the admissible pollutant emissions of internal combustion engines necessitate the implementation of various measures for lowering the pollutant emissions. One approach for reducing engine-internal pollutant emissions is increasing the injection pressure of the required fuel. A higher injection pressure, however, also entails a higher overall pressure at least within the high-pressure region of the system. As a result, high-pressure-conducting components of the system must be adapted to the higher overall pressure.

SUMMARY

Teachings of the present disclosure may support efficient operation of a fuel supply system for an internal combustion engine and to the inexpensive production of said fuel supply system.

In some embodiments, a fuel supply system (1) may include: a high-pressure pump (3), a pressure-limiting valve (5), and a high-pressure fluid accumulator (7). The high-pressure pump (3) is, at the outlet side, coupled in terms of flow to the pressure-limiting valve (5) and to the high-pressure fluid accumulator (7). When the internal combustion engine is set into a deactivated state, the high-pressure pump (3) is actuated such that, at the outlet side of the high-pressure pump (3), a pressure is increased such that the pressure-limiting valve (5) is opened.

In some embodiments, the pressure-limiting valve (5) is in the form of a direct-acting safety valve.

In some embodiments, the pressure-limiting valve (5) is, at the outlet side, connected in terms of flow to a low-pressure region of the fuel supply system (1) at the inlet side of the high-pressure pump (3).

In some embodiments, the pressure-limiting valve (5) is, at the outlet side, connected in terms of flow to a stroke chamber of the high-pressure pump (3).

In some embodiments, a predefined opening threshold of the pressure-limiting valve (5) is between 50 bar and 90 bar higher than a predefined nominal pressure of the fuel supply system (1).

In some embodiments, the predefined nominal pressure of the fuel supply system (1) at the outlet side of the high-pressure pump (3) is between 200 bar and 350 bar.

In some embodiments, a predefined closure threshold of the pressure-limiting valve (5) is between 50 bar and 150 bar, and is in particular 100 bar.

In some embodiments, the fuel supply system (1) has a high-pressure sensor (27), the measurement signal of which is representative of the pressure at the outlet side of the high-pressure pump (3), wherein an actuation of the high-pressure pump (3) is ended in a manner dependent on the measurement signal of the high-pressure sensor (27).

Some embodiments may include a device for operating a fuel supply system (1), which device is designed for carrying out a method as described above.

BRIEF DESCRIPTION OF THE DRAWINGS

Exemplary embodiments of the invention will be discussed below referring to the schematic drawings, in which.

Figure 1:
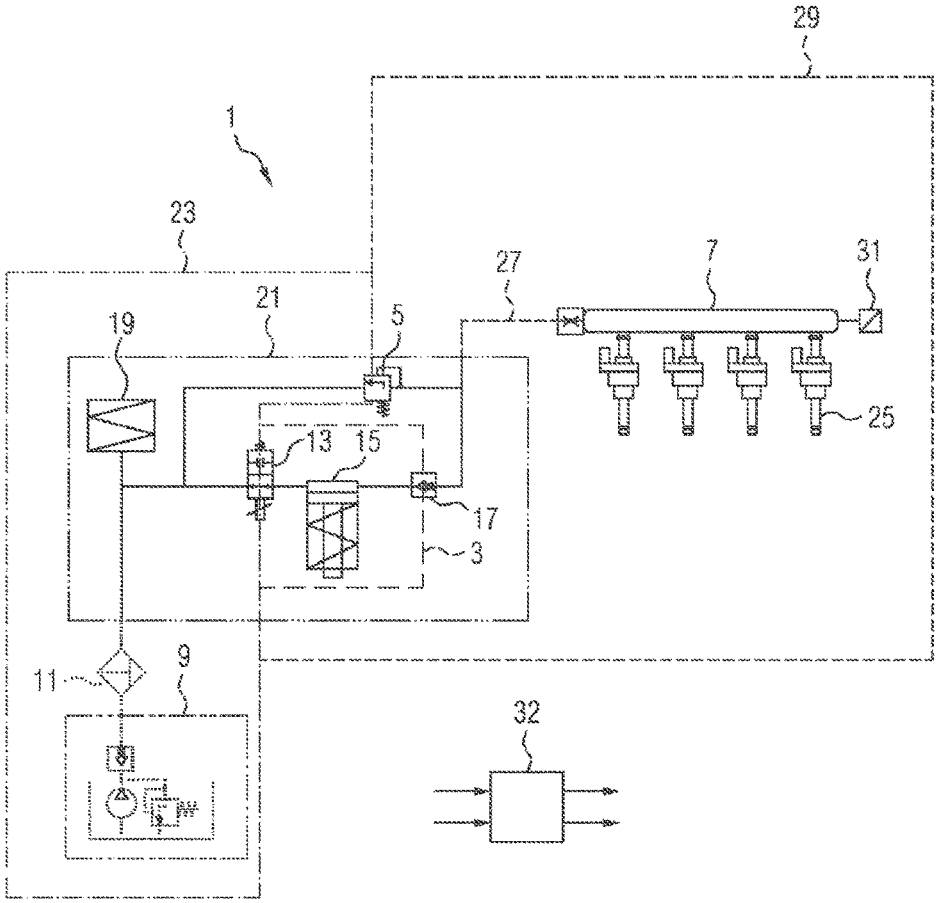
FIG. 1 shows a first exemplary embodiment of a fuel supply system for an internal combustion engine, according to teachings of the present disclosure.

Elements of identical construction or function are denoted by the same reference designations throughout the figures.

DETAILED DESCRIPTION

In some embodiments, a fuel supply system for an internal combustion engine has a high-pressure pump, a pressure-limiting valve and a high-pressure fluid accumulator. The high-pressure pump is, at the outlet side, connected in terms of flow to the pressure-limiting valve. Furthermore, the high-pressure pump is, at the outlet side, connected in terms of flow to the high-pressure fluid accumulator.

When the internal combustion engine is set into a deactivated state, the high-pressure pump is actuated such that, at the outlet side of the high-pressure pump, a pressure is increased such that the pressure-limiting valve is opened.

When the internal combustion engine is in the deactivated state, fuel leakage from the fuel supply system is dependent on the outlet-side pressure of the high-pressure pump. A reduction of the pressure by way of the pressure-limiting valve, for example by way of a return of fuel, is thus conducive to low-emission operation of the fuel supply system.

For example, it is also possible for a demand for closed-state leak-tightness of injection valves of the fuel supply system to be kept low. Through the use of the pressure-limiting valve, which is imperatively necessary for safety reasons, the need for installing an additional pressure-dissipating valve is eliminated, which is conducive to particularly inexpensive production of the fuel supply system. The pressure-limiting valve is opened in particular as a result of a pressure difference between the inlet side and outlet side of the pressure-limiting valve exceeding a predefined opening threshold. When the pressure-limiting valve is opened, the pressure at the outlet side of the high-pressure pump is dissipated via the pressure-limiting valve.

In this context, the pressure-limiting valve exhibits, for example, a particularly large hysteresis in which a predefined closure threshold of the pressure-limiting valve is significantly lower than the predefined opening threshold.

When the internal combustion engine is set into the deactivated state, it is in particular the case that a further metering of fuel is ended. After the ending of the further metering of fuel, the high-pressure pump continues to be operated in order to increase the pressure at the outlet side.

For example, the high-pressure pump has an inlet valve. In particular, an actuation of the high-pressure pump, in particular with regard to a pumping action of the high-pressure pump, is made possible by actuation of the inlet valve.

A coupling of the high-pressure pump in terms of flow to the pressure-limiting valve and to the high-pressure fluid accumulator is in particular a hydraulic coupling. A region at the outlet side of the high-pressure pump can also be referred to as high-pressure region.

In some embodiments, the pressure-limiting valve is in the form of a direct-acting safety valve. These embodiments are conducive to realizing particularly inexpensive production of the fuel supply system, in particular with regard to a pressure-regulating valve that is used in diesel supply systems. The pressure-limiting valve is for example in the form of a spring-loaded safety valve. The pressure-limiting valve may in particular be a check valve.

In some embodiments, the first pressure-limiting valve is, at the outlet side, connected in terms of flow to a low-pressure region of the fuel supply system at the inlet side of the high-pressure pump. The reduction of the pressure by way of the pressure-limiting valve as a result of the return of fuel into the low-pressure region is conducive to keeping fuel leakage through injection valves of the fuel supply system low.

The outlet-side coupling of the pressure-limiting valve in terms of flow to the low-pressure region is conducive to realizing a limitation of a maximum pressure at the outlet side of the high-pressure pump if a pumping action of the high-pressure pump cannot be limited, for example owing to a faulty inlet valve of the high-pressure pump. In particular, the maximum pressure is lower in this case than in the case of the pressure-limiting valve being connected in terms of flow to a stroke chamber of the high-pressure pump.

In some embodiments, the pressure-limiting valve is, at the outlet side, connected in terms of flow to a stroke chamber of the high-pressure pump. The reduction of the pressure by way of the pressure-limiting valve as a result of the return of fuel into the stroke chamber is conducive to keeping fuel leakage through injection valves of the fuel supply system low. A coupling of the pressure-limiting valve in terms of flow to the stroke chamber is furthermore conducive to enabling the predefined opening threshold of the pressure-limiting valve to be kept low. In particular, the maximum pressure at the outlet side of the high-pressure pump during normal operation of the fuel supply system is thus lower than in the case of the pressure-limiting valve being connected in terms of flow to the low-pressure region.

The pressure-limiting valve is designed to open if the pressure difference between the pressure at the outlet side of the high-pressure pump and a pressure in the stroke chamber of the high-pressure pump exceeds the predefined opening threshold. This is the case for example only in a suction phase of the high-pressure pump, such that a time period in which the pressure-limiting valve can open is shorter than in the case of the pressure-limiting valve being connected in terms of flow to the low-pressure region. As a result, the predefined opening threshold of the pressure-limiting valve is for example dimensioned to be lower than in the case of the pressure-limiting valve being connected in terms of flow to the low-pressure region.

In some embodiments, the predefined opening threshold of the pressure-limiting valve is between 50 bar and 90 bar higher than a predefined nominal pressure of the fuel supply system. Such an opening threshold is conducive to realizing a limitation of the maximum pressure, such that a demand for pressure resistance of one or more components at the outlet side of the high-pressure pump can be kept low. In particular, the predefined opening threshold is in this case dimensioned such that the pressure-limiting valve opens only in the event of an extreme exceedance of the predefined nominal pressure, such that the pressure-limiting valve can be produced inexpensively owing to the resulting limited number of opening processes.

In particular, the predefined opening threshold is between 50 bar and 70 bar in the case of the pressure-limiting valve being connected in terms of flow to the stroke chamber of the high-pressure pump. In particular, the predefined opening threshold is between 70 bar and 90 bar in the case of the pressure-limiting valve being connected in terms of flow to the low-pressure region.

In some embodiments, the predefined nominal pressure of the fuel supply system at the outlet side of the high-pressure pump is between 200 bar and 350 bar. This is conducive to low-emission operation of the internal combustion engine.

In some embodiments, a predefined closure threshold of the pressure-limiting valve is between 50 bar and 150 bar, in particular 100 bar. Such a closure threshold is conducive to realizing a limitation of the reduction of the pressure at the outlet side of the high-pressure pump, such that the pressure is in particular sufficient to set the internal combustion engine in operation. In particular, the predefined closure threshold is significantly lower than the predefined opening threshold, such that a dissipation of the pressure is made possible. In some embodiments, the fuel supply system comprises a high-pressure sensor, the measurement signal of which is representative of the pressure at the outlet side of the high-pressure pump. An actuation of the high-pressure pump is ended in a manner dependent on the measurement signal of the high-pressure sensor.

This makes it possible for a pumping action of the high-pressure pump to be ended early. This is conducive to realizing a fast dissipation of the pressure and keeping the fuel leakage particularly low. Furthermore, in this way, an unnecessary actuation of the high-pressure pump is avoided, which is conducive to realizing efficient operation of the fuel supply system.

The actuation of the high-pressure pump is ended in particular if the measurement signal is representative of an exceedance of the predefined opening threshold.

In some embodiments, a device for operating a fuel supply system is designed for carrying out a method such as that described above. A fuel supply system 1 (FIG. 1) for an internal combustion engine has a high-pressure pump 3 and has a pressure-limiting valve 5 and a high-pressure fluid accumulator 7. The high-pressure pump 3 is, at the outlet side, connected in terms of flow to the pressure-limiting valve 5 and to the high-pressure fluid accumulator 7.

The fuel supply system 1 furthermore has a fluid reservoir 9 which provides a fluid, in particular a fuel for a combustion process of the internal combustion engine. Here, the fluid is in particular gasoline. The fluid reservoir 9 is connected in terms of flow to the inlet side of the high-pressure pump 3. A fluid filter 11 is for example arranged between the fluid reservoir 9 and the high-pressure pump 3. The fuel supply system 1 is arranged for example in a motor vehicle.

The high-pressure pump 3 is designed for increasing a pressure of the fluid at the outlet side of the high-pressure pump 3. In particular, the pressure at the outlet side of the high-pressure pump 3 is increased to a predefined nominal pressure of the fuel supply system 1, with which, for example, an injection is performed. The predefined nominal pressure of the fuel supply system 1 is in particular between 200 bar and 350 bar. The high-pressure pump 3 comprises, for example, an inlet valve 13. For example, the high-pressure pump 3 also comprises a piston pump and an outlet valve 17. In other embodiments, the high-pressure pump 3 is for example in the form of a pendulum-slide machine. The high-pressure pump 3 is in particular controllable so as to increase the pressure at the outlet side of the high-pressure pump 3.

In some embodiments, the inlet valve 13 is of controllable design. In the exemplary embodiment, for this purpose, the inlet valve 13 is for example in the form of a digital inlet valve.

A cycle of the high-pressure pump 3 is described for example by a suction phase and a delivery phase. The high-pressure pump 3 can be controlled in particular so as to suck fluid out of the fluid reservoir 9 into a stroke chamber of the high-pressure pump 3 in the suction phase of the high-pressure pump 3, in order to provide said fluid for the delivery phase. In the embodiment, in the suction phase of the high-pressure pump 3, fluid is sucked by the piston pump 15 into a piston chamber of the piston pump 15. The fluid that is sucked in is delivered by way of the interaction of the piston pump 15 with the inlet valve 13.

The fuel supply system 1 also has, for example, a damper 19. Said damper is in particular a low-pressure damper. For example, the high-pressure pump 3, the damper 19 and the pressure-limiting valve 5 are formed in a single structural unit 21. The damper 19 is for example connected in terms of flow to the high-pressure pump 3 at the inlet side of the latter.

In particular, the fluid reservoir 9, the fluid filter 11 and the damper 19 are arranged in a low-pressure region 23 of the fuel supply system 1. The damper 19 is designed to provide a volume in the low-pressure region 23 for the purposes of compensating pressure fluctuations.

The high-pressure fluid accumulator 7 has at least one injection valve 25. In the delivery phase of the high-pressure pump 3, fluid sucked in from the fluid reservoir 9 is supplied to the high-pressure fluid accumulator 7 and to the at least one injection valve 25. For this purpose, the high-pressure fluid accumulator 7 is connected in terms of flow to the outlet side of the high-pressure pump 3 via a feed line 27. The high-pressure pump 3, the pressure-limiting valve 5, the feed line 27 and the high-pressure fluid accumulator 7 with the at least one injection valve 25 are arranged for example in a high-pressure region 29 of the fuel supply system 1. For example, in the high-pressure region 29, there is additionally arranged a high-pressure sensor 31 which detects the pressure at the outlet side of the high-pressure pump 3.

The pressure-limiting valve 5 is opened in particular as a result of a pressure difference between the inlet side and outlet side of the pressure-limiting valve 5 exceeding a predefined opening threshold. In particular, the pressure-limiting valve 5 is conducive to realizing a limitation of a maximum pressure within the high-pressure region 29, such that a demand for pressure resistance of one or more components in the high-pressure region can be kept low. In particular, the pressure-limiting valve 5 is closed as a result of the pressure difference between the inlet side and outlet side of the pressure-limiting valve 5 falling below a predefined closure threshold.

In some embodiments, the pressure-limiting valve 5 is, at the outlet side, connected in terms of flow to the low-pressure region 23 of the fuel supply system 1. When the pressure-limiting valve 5 opens, the pressure within the high-pressure region 29 is dissipated via the pressure-limiting valve 5 into the low-pressure region 23. The predefined opening threshold is in this case between 70 bar and 90 bar above the predefined nominal pressure.

The fuel supply system 1 is for example also assigned a control device 32 for operating the fuel supply system 1, which control device comprises in particular a data and program memory. The control device 32 may also be referred to as a device for operating the fuel supply system 1.

Figure 2:
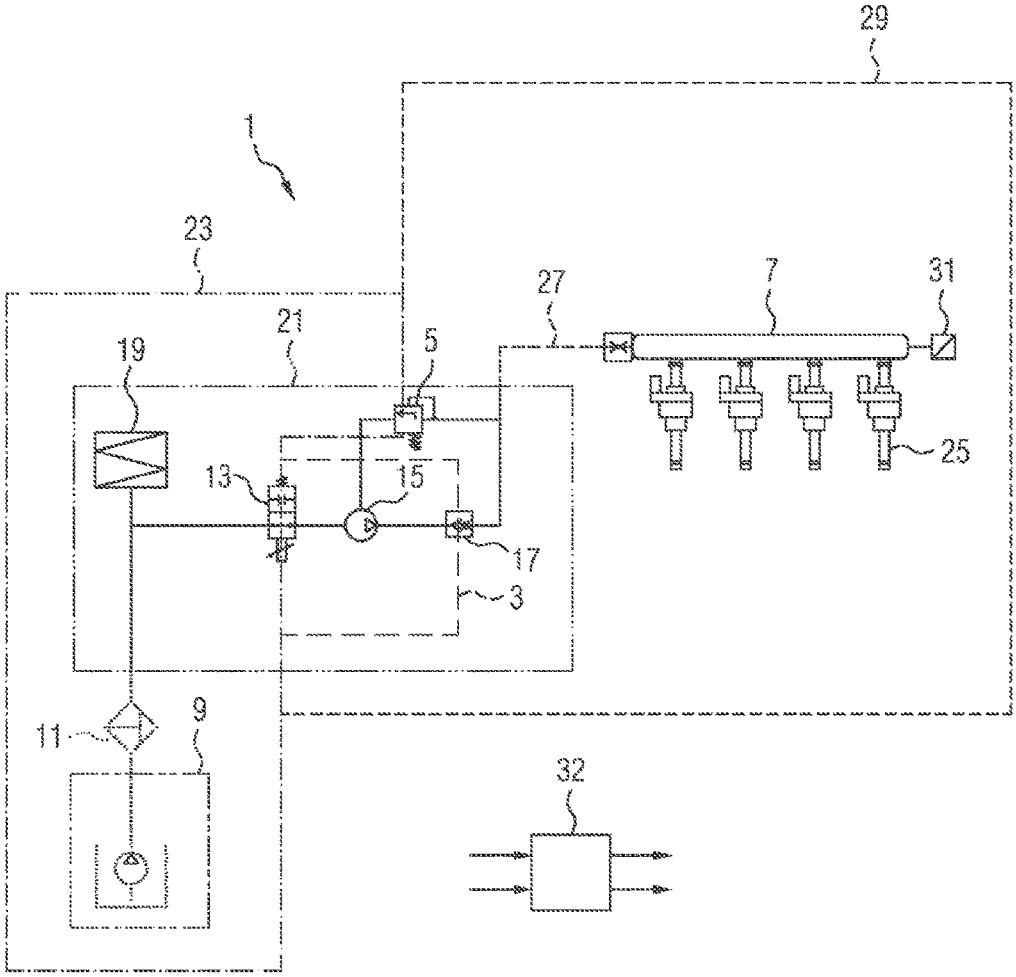
FIG. 2 shows a second exemplary embodiment of a fuel supply system for the internal combustion engine, according to teachings of the present disclosure.

A second exemplary embodiment (FIG. 2) differs from the first exemplary embodiment of FIG. 1 by the coupling in terms of flow at the outlet side of the pressure-limiting valve 5. In the second exemplary embodiment, the pressure-limiting valve 5 is, at the outlet side, connected in terms of flow to the stroke chamber of the high-pressure pump 3, in particular to the piston chamber of the piston pump 15. When the pressure-limiting valve 5 opens, the pressure within the high-pressure region 29 is dissipated via the pressure-limiting valve 5 into the stroke chamber. The predefined opening threshold is in this case between 50 bar and 70 bar above the predefined nominal pressure.

At a time at which the internal combustion engine is set into a deactivated state, the pressure in the high-pressure region 29 typically corresponds to the predefined nominal pressure of the fuel supply system 1. In a manner dependent on closed-state leak-tightness of components arranged in the high-pressure region 29, in particular of the pressure-limiting valve 5, of the outlet valve 3 and of the at least one injection valve 25, a dissipation of the pressure takes place after the internal combustion engine has been set into the deactivated state, by way of fuel leakage of the respective component. The fuel leakage of the respective components is in this case dependent on the pressure in the high-pressure region 29.

Figure 3:
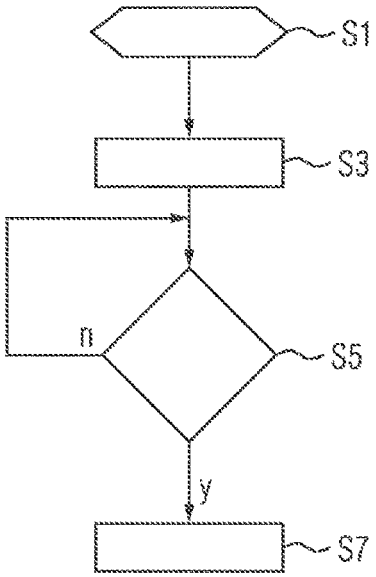
FIG. 3 shows a flow diagram for the operation of a fuel supply system as per FIG. 1 and FIG. 2.

In particular, there is stored in the data and program memory of the control device 32 a program which will be discussed in more detail below on the basis of the flow diagram of FIG. 3.

The program is started in a step S1, for example when the internal combustion engine is set into the deactivated state. Here, firstly, it is the case in particular that a further metering of fuel is ended. For example, in this context, a control signal is generated for closing the at least one injection valve 25.

At the time at which the internal combustion engine is set into the deactivated state, the pressure in the high-pressure region 29 corresponds, for example, to the predefined nominal pressure of the fuel supply system 1.

In a step S3, the high-pressure pump 3 is actuated such that the pressure in the high-pressure region 29 is increased. For this purpose, it is for example the case that the inlet valve 13 is actuated so as to open in the suction phase of the high-pressure pump 3. Furthermore, the valve 13 is for example actuated so as to close in the delivery phase of the high-pressure pump 3.

As a result of an increase in the pressure in the high-pressure region 29, the pressure difference across the pressure-limiting valve 5 exceeds the predefined opening threshold of the pressure-limiting valve 5. As a result, the pressure-limiting valve 5 opens, and the pressure in the high-pressure region 29 is dissipated until the pressure difference across the pressure-limiting valve 5 falls below the predefined closure threshold, and the pressure-limiting valve 5 closes again.

The pressure-limiting valve 5 exhibits hysteresis, in the case of which the predefined opening threshold is suitably higher, in particular significantly higher, than the predefined closure threshold, such that, after dissipation of the pressure, a pressure level in the high-pressure region 29 is for example suitably lower than the predefined nominal pressure. The predefined closure threshold is in this case in particular between 50 bar and 150 bar in order to be able to make it reliably possible for the internal combustion engine to be set into the activated state. In particular, the predefined closure threshold is 100 bar.

For example, the high-pressure pump 3 is mechanically coupled to the internal combustion engine. In this case, the high-pressure pump 3 merely converts residual rotational energy provided by the internal combustion engine into stroke work, such that a pumping action of the high-pressure pump 3 is limited in terms of time. For example, the program is continued in a step S7 after a predefined time duration, for example after a minimum pumping action of the high-pressure pump 3 is undershot.

If the fuel supply system 1 has the high-pressure sensor 31, then it is checked in a step S5 whether the predefined opening threshold is exceeded. If the predefined opening threshold is exceeded, the program is continued in the step S7. Otherwise, the step S5 is repeated.

In the step S7, the actuation of the high-pressure pump 3 for a further build-up of pressure is ended. For example, in this context, the inlet valve 13 is actuated such that, at least, no further delivery of the sucked-in fluid occurs. The program is subsequently ended.

Figure 4:
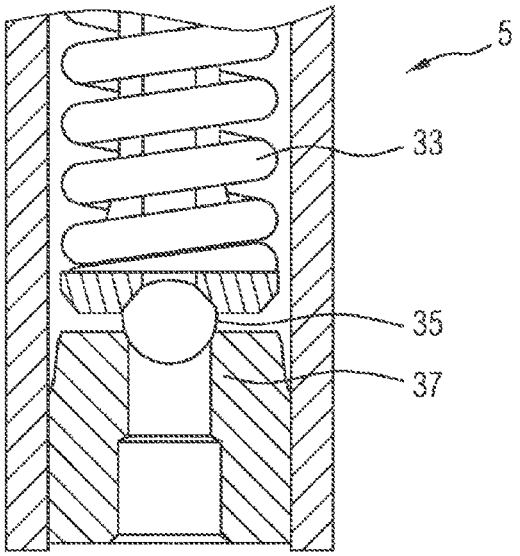
FIG. 4 shows a longitudinal section through a pressure-limiting valve of a fuel supply system as per FIG. 1 and FIG. 2.

The pressure-limiting valve 5 is for example in the form of a direct-acting safety valve (FIG. 4). The pressure-limiting valve 5 can thus be produced particularly inexpensively.

The pressure-limiting valve 5 has, for example, a spring 33 which presses a ball 35 into a valve seat 37, counter to a pressure at the inlet side of the pressure-limiting valve 5, in order to close the pressure-limiting valve 5. In a manner dependent on a spring force of the spring 33, the pressure-limiting valve 5 has the predefined opening threshold and the predefined closure threshold, such that the pressure-limiting valve 5 is opened and closed in a manner dependent on the inlet-side pressure and an outlet-side pressure.

What is claimed is:

1. A method for operating a fuel supply system of an internal combustion engine, wherein the fuel supply system includes a pump having an outlet coupled to a high-pressure region including a fluid accumulator, wherein a normal operating pressure of the high-pressure region is between 200 bar and 350 bar, and a pressure-limiting valve having an inlet coupled to the high-pressure region including the fluid accumulator, the method comprising:

when the internal combustion engine is set into a deactivated state, actuating the pump such that, at the outlet side of the pump, a pressure is increased in the high-pressure region including the fluid accumulator to a sufficient extent that the pressure-limiting valve is opened by the pressure in the high-pressure region acting on the inlet of the pressure-limiting valve; and monitoring a pressure at the outlet of the pump and ceasing actuation of the pump when the pressure exceeds a predefined opening threshold of the pressure-limiting valve;

wherein the pressure limiting valve has an opening pressure less than 90 bar above the normal operating pressure of the high-pressure region and a closure threshold between 50 bar and 150 bar.

2. The method as claimed in claim 1, wherein the pressure-limiting valve comprises a direct-acting safety valve.

3. The method as claimed claim 1, wherein the pressure-limiting valve connects the outlet of the pump to a low-pressure region of the fuel supply system at the inlet side of the pump.

4. The method as claimed in claim 1, wherein the pressure-limiting valve connects the outlet side of the high-pressure pump to a stroke chamber of the pump.

5. The method as claimed in claim 1, wherein a predefined closure threshold of the pressure-limiting valve is between 90 bar and 150 bar.

6. The method as claimed in claim 1, wherein the fuel supply system includes a sensor generating a measurement signal representative of the pressure at the outlet side of the pump.

7. A fuel supply system of an internal combustion engine, the fuel supply system comprising:

a pump having an outlet coupled to a high-pressure region with a normal operating pressure in the high-pressure region between 200 bar and 350 bar;

a fluid accumulator arranged in the high-pressure region coupled to the outlet of the pump;

a pressure-limiting valve having an inlet coupled to an outlet of the pump and coupled to the high-pressure region including the fluid accumulator;

a sensor measuring a pressure at the outlet of the pump; and wherein actuation of the pump continues after the internal combustion engine has been deactivated until the sensor measures a pressure at the outlet side of the pump exceeding a predetermined opening value of the pressure-limiting valve;

wherein the pressure limiting valve has an opening pressure less than 90 bar above the normal operating pressure of the high-pressure region and a closure threshold of between 50bar and 150 bar.

8. The fuel system as claimed in claim 7, wherein the pressure-limiting valve comprises a direct-acting safety valve.

9. The fuel system as claimed in claim 7, wherein the pressure-limiting valve connects the outlet of the pump to a relatively lower pressure region of the fuel supply system at the inlet side of the pump.

10. The fuel system as claimed in claim 7, wherein the pressure-limiting valve connects the outlet side of the high-pressure pump to a stroke chamber of the pump.

11. The fuel system as claimed in claim 7, wherein a predefined closure threshold of the pressure-limiting valve is between 90 bar and 150 bar.

12. The fuel system as claimed in claim 7, wherein actuation of the pump is ended based at least in part on the measurement signal of the sensor.

* * * * *